US011220886B2

(12) United States Patent
Maclurg

(10) Patent No.: US 11,220,886 B2
(45) Date of Patent: Jan. 11, 2022

(54) DOWNHOLE APPARATUS

(71) Applicant: Weatherford U.K. Limited, Leicestershire (GB)

(72) Inventor: Michael John Maclurg, Aberdeenshire (GB)

(73) Assignee: Weatherford U.K. Limited, Leicestershire (GB)

( * ) Notice: Subject to any disclaimer, the term of this patent is extended or adjusted under 35 U.S.C. 154(b) by 0 days.

(21) Appl. No.: 16/641,490

(22) PCT Filed: Sep. 28, 2018

(86) PCT No.: PCT/GB2018/052773

§ 371 (c)(1),
(2) Date: Feb. 24, 2020

(87) PCT Pub. No.: WO2019/073200

PCT Pub. Date: Apr. 18, 2019

(65) Prior Publication Data

US 2021/0148188 A1 May 20, 2021

(51) Int. Cl.
*E21B 34/14* (2006.01)
*E21B 33/129* (2006.01)
(Continued)

(52) U.S. Cl.
CPC ..... *E21B 34/142* (2020.05); *E21B 33/1294* (2013.01); *E21B 33/146* (2013.01);
(Continued)

(58) Field of Classification Search
CPC ..... E21B 34/14; E21B 34/142; E21B 34/10; E21B 2200/04; E21B 2200/06; E21B 23/0413
See application file for complete search history.

(56) References Cited

U.S. PATENT DOCUMENTS 3,948,322 A * 4/1976 Baker ..... E21B 33/16 166/289
6,401,822 B1 6/2002 Baugh
(Continued)

FOREIGN PATENT DOCUMENTS

| | | |
|---|---|---|
| CA | 2429506 A1 | 11/2004 |
| GB | 2048989 A | 12/1980 |
| WO | 2008119931 A1 | 10/2008 |

OTHER PUBLICATIONS

UK Search Report received in copending UK Application No. GB1800522.3, dated Jul. 2, 2018, 7 pages.
(Continued)

*Primary Examiner* — Tara Schimpf
(74) *Attorney, Agent, or Firm* — Blank Rome LLP

(57) ABSTRACT

A downhole apparatus comprises a housing, a seat mounted in the housing and configured to receive an object such that the object may engage and axially move the seat to operate the downhole apparatus, and a moveable barrier located on one axial side of the seat such that when an object is engaged with the seat a volume is defined between the object and the moveable barrier, wherein the moveable barrier permits said volume to be moved within the apparatus to allow the object to axially move the seat.

13 Claims, 4 Drawing Sheets

(51) Int. Cl.
*E21B 34/10* (2006.01)
*E21B 33/14* (2006.01)
*E21B 23/04* (2006.01)

(52) U.S. Cl.
CPC ..... *E21B 34/10* (2013.01); *E21B 34/14* (2013.01); *E21B 23/0413* (2020.05); *E21B 2200/04* (2020.05); *E21B 2200/06* (2020.05)

(56) References Cited

U.S. PATENT DOCUMENTS

| | | | |
|---|---|---|---|
| 2002/0148614 | A1 | 10/2002 | Szarka et al. |
| 2007/0181188 | A1 | 8/2007 | Branch et al. |
| 2014/0332277 | A1 | 11/2014 | Churchill |

OTHER PUBLICATIONS

PCT Search Report received in copending PCT Application No. PCT/GB2018/052773, dated Dec. 7, 2018, 10 pages.

* cited by examiner

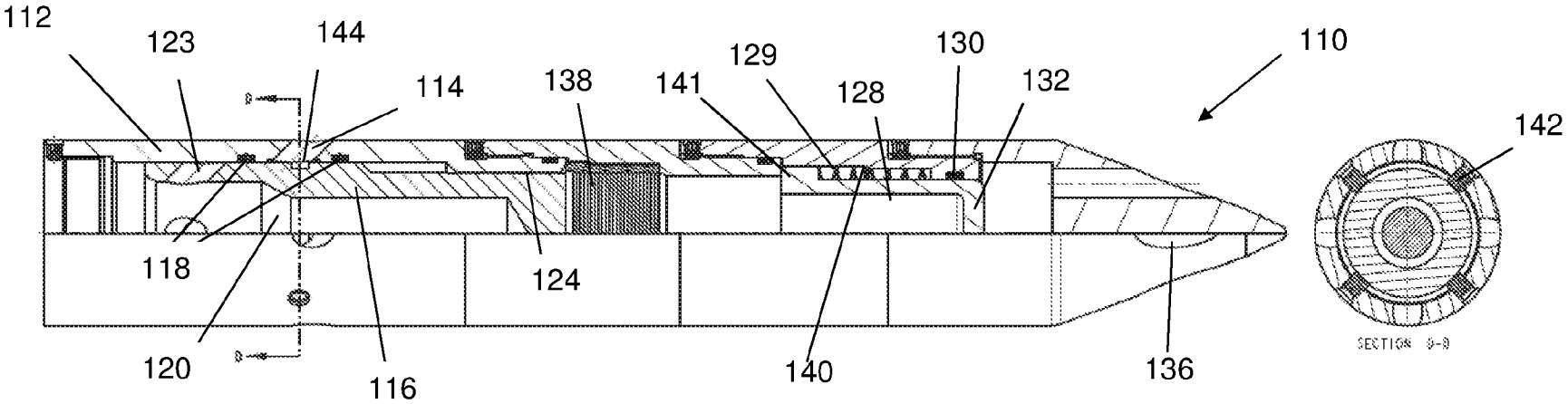
FIGURE 3B
FIGURE 3A
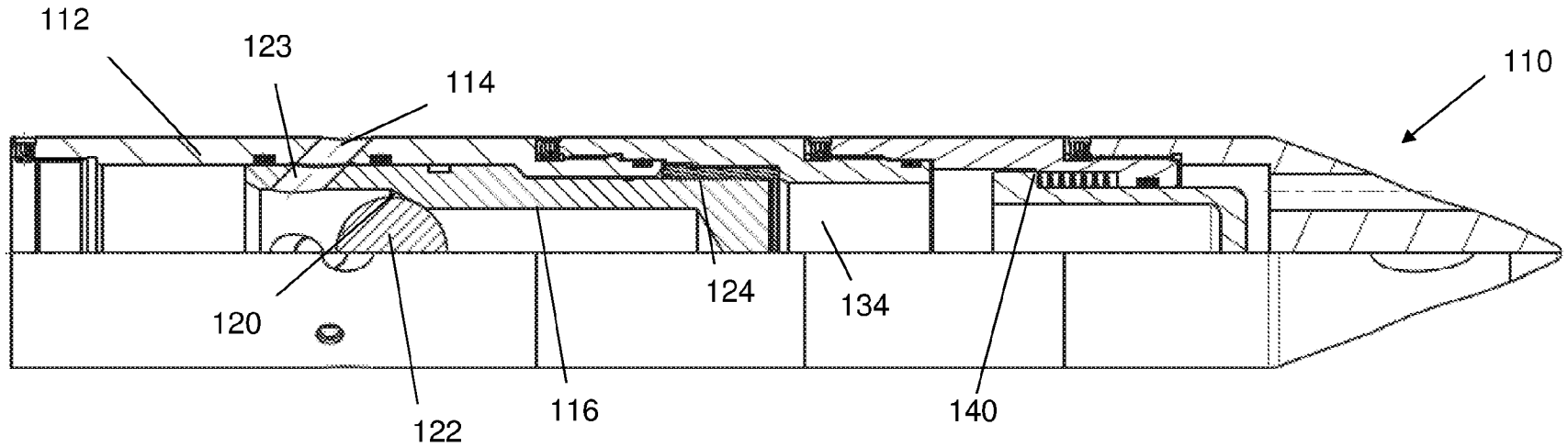
FIGURE 4

DOWNHOLE APPARATUS

FIELD

The present disclosure relates to a downhole apparatus to be operated by a dropped object, such as a ball.

BACKGROUND

In the oil and gas industry many operations are performed downhole in a wellbore. Downhole tools may be operated in response to numerous types of actuation, such as by delivering a wireless signal, such as a pressure based signal, acoustic signal, EM signal or the like. Such signal based actuation may require complex and expensive systems. It is also known to deploy shifting or operating tools on slickline. Utilizing a slickline solution may in some cases be undesirable due to the associated rig-up of equipment to support the slickline operation. It is also known to provide hydraulic actuation via a piston which may be initially held by a shear pin. Such an arrangement, however, may be subject to premature release.

In some examples objects, such as balls, may be dropped from surface to land in a seat, wherein momentum and/or pressure developed behind the object may be used to cause the seat to shift and provide some actuation event. However, in some examples the use of a dropped object may not be possible due to the possible creation of a trapped volume of fluid below the dropped object when landed on its seat. Such an issue may exist in tubing hanger plugs, for example.

SUMMARY

An aspect of the present disclosure relates to a downhole apparatus, comprising: a housing; a seat mounted in the housing and configured to receive an object such that the object may engage and axially move the seat to operate the downhole apparatus; and a moveable barrier located on one axial side of the seat such that when an object is engaged with the seat a volume is defined between the object and the moveable barrier, wherein the moveable barrier permits said volume to be moved within the apparatus to allow the object to axially move the seat.

Accordingly, in use, the moveable barrier may allow the trapped volume on one axial side, for example below the object, from preventing the object and engaged seat from moving axially (i.e., preventing hydraulic lock).

The downhole apparatus may comprise or define a tubing hanger plug.

The moveable barrier may define a sealed barrier. In this respect, the moveable barrier may prevent flow along or through the housing. Such a sealed barrier may function to cause fluid to become trapped between the barrier and the object when engaged with the seat. This trapped volume, however, is moveable by virtue of the barrier being moveable.

The downhole apparatus may comprise a valve, wherein the valve is reconfigurable at least from a closed position to an open position upon axial movement of the seat. That is, the seat is operatively associated with the valve. In some examples the valve may be reconfigurable between an open position and a closed position upon axial movement of the seat.

The downhole apparatus may comprise a valve member, wherein movement of the seat causes corresponding movement of the valve member. The valve member and the seat may be integrally formed. In one example the seat may define the valve member. In an alternative example the seat and valve member may be separately formed.

The valve member may comprise or define a valve sleeve.

The valve member may be comprised of multiple parts. For example, the valve member may comprise an upper part and a lower part. The valve member may comprise an intermediate part, or a number of intermediate parts, located between the upper part and the lower part. A part, for example the upper part, of the valve member may be used to facilitate actuation of a secondary device in the apparatus.

The valve member may function to protect a part of the apparatus. For example, the valve member may cover a part of the apparatus. The valve member may be used to protect a seal in the apparatus. The valve member may be comprised of multiple parts which work together, or interact, to protect part of the valve member. For example, the valve member may comprise a first part, e.g. an intermediate or lower part, which protects a part of the apparatus when the apparatus is in a closed position, and a second part, e.g., an upper part which protects a part of the apparatus when the valve member is in an open position.

The housing may define at least one port in a wall thereof, wherein the valve member may be configured to initially close said at least one flow port and be axially moved by the seat to cause said at least one flow port to open. The at least one flow port may be opened to provide pressure equalization across the downhole apparatus.

A sealing arrangement may provide sealing between the valve member and the housing at least when the valve member is in a closed position. The sealing arrangement may straddle the at least one flow port when the valve member is in a closed position.

The object may comprise any suitable object which can function to engage the seat. Numerous example objects are known in the art. In some examples the object may comprise a ball. The object may alternatively comprise a dart, for example.

The seat may comprise an object engaging surface. The object engaging surface may be configured to compliment the shape of the object.

The object engaging surface may be located on an upper, i.e. uphole, extremity of the seat. The seat may define an uphole surface, the uphole surface being nonparallel to the axial direction of flow through the apparatus, and located at an upper extremity of the seat. The uphole surface may at least partially define the object engaging surface.

The object engaging surface may be located at an intermediate location on the seat, i.e. not on the uphole surface of the seat.

The seat may comprise a bypass configured to permit fluid to bypass an object when engaged with the seat. The bypass may permit fluid to bypass an object by permitting fluid to flow from a location in the apparatus uphole of the object, to a location of the apparatus downhole of said object. The bypass may permit fluid to bypass an object by permitting fluid to flow from a location inside the apparatus uphole of an object to a location external to the apparatus, e.g. external to the housing of the apparatus.

The bypass may comprise one or more ports.

The bypass may comprise an inlet port and an outlet port. The inlet port may be positioned such that engagement of an object with the object engaging surface permits, e.g. does not restrict, flow through in inlet port.

The uphole surface may comprise or define the inlet port.

In some examples, the inlet port may be defined by the valve member uphole of the object engaging surface.

The outlet port may align or be alignable with a housing port, so as to permit flow to a location external to the apparatus. Alignment of the outlet port with the housing port may be dependent on the seat being moveable within the housing, and dependent on the relative position of the seat in the housing.

The flow area of the bypass may be greater than the flow area of a central bore in the housing. As such, the bypass may not provide a restriction in the flow area of the apparatus.

The seat may be moveable between a closed position, in which there is no alignment with the outlet port and the housing port and there is no fluid communication therebetween, and an open position in which there is full alignment between the outlet port and the housing port and minimal restriction to fluid communication therebetween. The seat may be moveable between a plurality of intermediate positions. An intermediate position may be defined by a partial overlap of the outlet port and the housing port, such that fluid communication is possible to a restricted degree.

As the seat moves from the closed position to the open position, the seat may move through the plurality of intermediate positions. In moving through the plurality of intermediate positions, flow through the outlet port may be gradually increased. The shape of the outlet port and/or the housing port may be selected so as to provide a desired rate of flow increase as the seat moves through the plurality of intermediate positions. For example, the shape of the outlet port and/or the housing port may be selected so as to provide a gradual rate of flow increase as the seat moves through the plurality of intermediate positions. The outlet port and/or the housing port may have an oval shape, a circular shape, a polygonal shape, or the like. A gradual rate of flow increase may prevent sudden drops, or increases, in pressure within the apparatus, and/or may prevent damage to sections of the apparatus.

The bypass, or at least part of the bypass, may extend in an axial direction. The bypass, or at least part of the bypass may extend in a radial direction.

The bypass, or at least part of the bypass may extend in an oblique direction. The bypass extending in an oblique direction may function to reduce erosion of the apparatus, and/or of a tubular such as a pipe or section of casing, in which the apparatus is placed, by directing fluid flowing from the apparatus so as to reduce the impact of the fluid on a tubular, pipe, casing or the like.

The bypass may extend in a straight line, i.e. a straight line in any direction, but without a bend or undulation. The bypass may extend in a straight line such that, when the seat is in the open position, the inlet port, the outlet port and the housing port align in a straight line. In such configurations, the flow losses as a result of fluid flow in the bypass may be reduced.

The apparatus may comprise a latching mechanism. The latching mechanism may function to provide latching of the seat in at least one position. The latching mechanism may function to provide latching in multiple positions. In an example where the downhole apparatus comprises a valve, the latching mechanism may provide latching of the seat in respective positions which correspond to the valve being open and the valve being closed. The latching mechanism may comprise a collet arrangement. The latching mechanism may comprise a ratchet arrangement.

The moveable barrier may comprise a piston member axially moveable within the housing. The moveable barrier member may define a cap form.

The moveable barrier may be sealed relative to the housing, for example via one or more dynamic seals, such as one or more O-rings.

The moveable barrier may comprise a bellows structure.

The moveable barrier may comprise a flexible membrane.

The moveable barrier may be biased in one axial direction. Such a bias may be provided by a biasing mechanism such as a spring, or the like.

Movement of the movable barrier may be limited. The housing may comprise a structure, e.g. a ridge or a rib, to limit movement of the moveable barrier. Movement of the moveable barrier may be limited, for example, by the structure of the housing. Movement of the moveable barrier in the axial direction against the bias direction of the biasing member may be limited by the structure of the housing. Limiting the movement of the moveable barrier may prevent damage to the biasing mechanism.

The housing may define fluid ports configured to permit downhole pressure/fluid to enter the housing on one side of the moveable barrier. The moveable barrier may isolate a section, for example an upper section, of the apparatus form the downhole pressure/fluid.

The housing may comprise a unitary or multiple parts.

The housing may comprise a sealing arrangement on an outer surface thereof, The sealing arrangement may facilitate sealing of the apparatus in a tubular, pipe, casing or the like in which it may be located.

An aspect of the present disclosure relates to a method for operating a downhole apparatus.

The method may comprise flowing a fluid through the apparatus.

The method may comprise actuating the apparatus by moving a sleeve in the apparatus so as to open a housing port in a housing of the apparatus. The method may comprise applying a pressurized fluid to the apparatus to prime the apparatus before actuation thereof.

The method may comprise locating (e.g. by dropping) an object into the apparatus to actuate the apparatus. The method may comprise engaging the object in a seat within the apparatus to actuate the apparatus. The method may comprise generating a differential pressure across the object, when the object is engaged in the seat. The method may comprise moving the seat, as a result of the differential pressure thereacross, so as to move the sleeve in the apparatus and thus actuate the apparatus.

The method may comprise providing a moveable barrier within the apparatus. The method may comprise moving the moveable barrier simultaneously as the apparatus is actuated. The method may comprise moving the moveable barrier simultaneously as the sleeve in the apparatus is moved. Movement of the moveable barrier may allow the sleeve to be moved without suffering a hydraulic lock in the apparatus.

The method may comprise defining a volume between the object and the moveable barrier. The method may comprise defining a sealed volume between the object engaged in the seat and the moveable barrier. The method may comprise moving the sleeve, the volume and the moveable barrier simultaneously along the apparatus (e.g. in an axial direction along the apparatus).

The downhole apparatus may be provided in accordance with any other aspect.

An aspect of the present disclosure relates to a tubing hanger plug. The tubing hanger plug may comprise or be provided in accordance with a downhole apparatus according to any other aspect.

An aspect of the present disclosure relates to a method for providing pressure equalization across a tubing hanger plug.

BRIEF DESCRIPTION OF THE DRAWINGS

These and other aspects of the present disclosure will now be described, by way of example only, with reference to the accompanying drawings, in which:

FIG. 3A is a cross sectional view of a second example of a downhole apparatus.

FIG. 3B is a cross-sectional view along section D-D of FIG. 3A.

FIG. 4 is a cross-sectional view of the downhole apparatus of FIG. 3A and FIG. 3B in a second configuration.

DETAILED DESCRIPTION OF THE DRAWINGS

Aspects of the present disclosure relate to a downhole apparatus and method of use. In some examples the downhole apparatus may be provided in the form of a tubing hanger plug. The exemplary description below relates to such an example tubing hanger plug.

Figure 1:
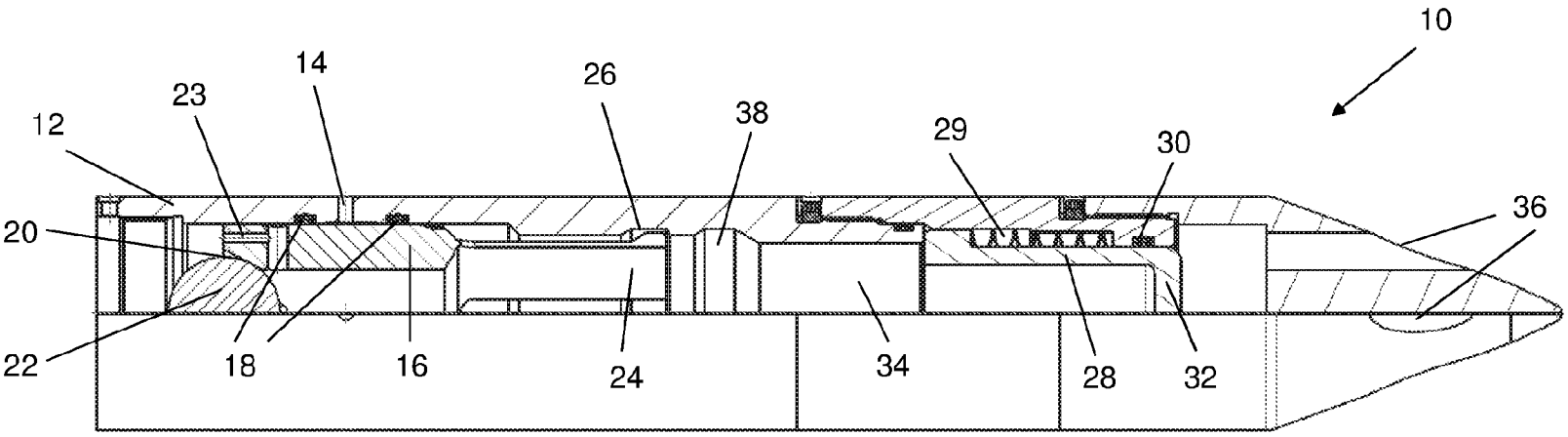
FIG. 1 is a cross-sectional view of a downhole apparatus in a first configuration.

Reference is first made to FIG. 1 in which a tubing hanger plug, generally identified by reference numeral 10 is shown. The tubing hanger plug 10 comprises a housing 12 which includes a number of fluid ports 14. A valve member in the form of a valve sleeve 16 is mounted within the housing 12 and in the initial configuration of FIG. 1 closes the fluid ports 14. O-ring seals 18 provide sealing between the valve sleeve 16 and housing 12.

One axial end, which may be defined as an upper end of the valve sleeve 16 and may form an uphole surface according to the present disclosure, defines a seat 20 which functions to be engaged by a ball 22 which has been dropped from surface. Although a ball is described and illustrated, any equivalent object, such as a dart, may alternatively be used. The seat 20 includes bypass ports 23 which facilitate fluid to bypass the ball 22 when engaged with the seat 20.

An opposite end of the valve sleeve 16 includes a latching structure in the form of a collet 24 which in the configuration shown in FIG. 1 is latched into a first annular recess 26 formed in the housing 12.

The tubing hanger plug 10 also includes a barrier member in the form of a floating piston 28 which is located below the valve sleeve 16. The floating piston 28 is sealed with the housing 12 via O-ring seals 30, and includes a closed or capped end 32, thus providing isolation above and below said floating piston 28, as might be required in a tubing hanger plug 10. That is, the floating piston 28 prevents flow along or through the housing 12. The floating piston 28 therefore may function as a primary internal barrier to fluid flow into the apparatus (i.e. into the apparatus uphole of the floating piston 28) from an external location. In the example illustrated the floating piston 28 is biased in an upward direction by a spring 29.

When the ball 22 is engaged with the seat 20, a trapped volume 34 is defined axially between the ball 22 and the floating piston 28.

Figure 2:
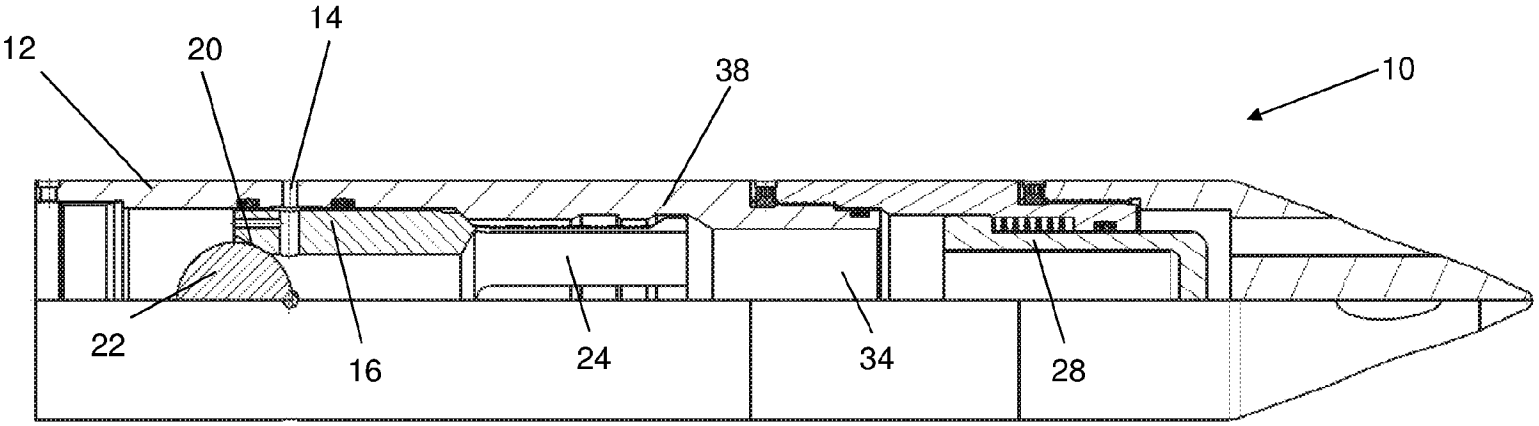
FIG. 2 is a cross-sectional view of the downhole apparatus of FIG. 1 in a second configuration.

In use, the ball 22 will act on the seat 20, and thus valve sleeve 16 and, as shown in FIG. 2, will cause the valve sleeve 16 to shift axially and open the ports 14, thus providing pressure equalizations across the tubing hanger plug 10.

Axial shifting of the ball 22 and valve seat 20 will cause the floating piston 28 to also move axially, thus permitting the trapped volume 34 to also move. In this respect, force applied via the ball will be transferred to the floating piston 28 via the trapped fluid. Accordingly, the floating piston 28 may function to prevent hydraulic lock within the tubing hanger plug 10. Such a trapped volume may otherwise prevent any movement of the seat 20 and associated valve sleeve 16.

The housing 12 further comprises lower ports 36 which function to expose the floating piston 28 to downhole pressure, thus avoiding any potential for the floating piston 28 from being hydraulically locked within the housing 12.

Although not shown, the housing 12 may comprise a sealing arrangement comprising one or more seals located on an outer surface thereof. The sealing arrangement may facilitate sealing of the tubing hanger plug 10 in a pipe, casing, tubular or the like.

When the valve sleeve 16 is positioned in its fully open position, as shown in FIG. 2, the collet 24 of the valve sleeve 16 is latched into a section annular recess 38.

Reference is now made to FIGS. 3A, 3B and 4, which illustrate a cross-sectional view of a second example of a downhole apparatus. FIGS. 3A, 3B and 4 share similarities with FIGS. 1 and 2, and as such like reference numerals have been used for like components, augmented by 100.

As in the previous example, the apparatus, shown as tubing hanger plug 110, comprises a housing 112 having a number of fluid ports 114. A valve sleeve 116 is mounted within the housing 112, and in the initial configuration of FIG. 3A closes the fluid ports 114. O-ring seals 118 are provided between the valve sleeve 116 and the housing 112 to seal the fluid ports 114 closed.

The valve sleeve 116 defines a seat 120, functional to be engaged by a ball 122 (shown in FIG. 4) which has been released from surface. In this example, the seat 120 is located at a midpoint along the valve sleeve 116, and is downhole of the upper axial end of the valve sleeve 116. According to the present disclosure, the seat 120 may be considered as having an intermediate location. The seat 120 includes bypass ports 123 which facilitate fluid bypassing the ball 122 (shown in FIG. 4) when engaged with the seat 120.

In the example shown in FIGS. 3A, 3B and 4, the bypass 123 is located uphole of the seat 120, such that the ball 122 engages the seat downhole of the bypass 123, and therefore would not provide any restriction to flow through the bypass 123.

As is most clearly shown in FIG. 3A and FIG. 4, the bypass 123 and the fluid ports 114 have a linear axis, which lies oblique relative to the axis of the hanger plug 110. The axes of the bypass 123 and the fluid ports 114 are parallel. As previously described, the fluid ports 114 being obliquely aligned with the axis of the hanger plug 110 may prevent erosion of a tubular, pipe, casing, or the like in which the hanger plug 110 is placed. Axial alignment of the bypass 123 and the fluid ports 114 may provide reduced fluid losses when there is fluid flow therethrough.

In this example, in contrast to the example of FIGS. 1 and 2, the bypass 123 does permit fluid to bypass the ball 122 when engaged in the seat 120.

An opposite, downhole, end of the valve sleeve 116 includes circumferentially extending teeth 124. In the configuration shown in FIG. 3A, the teeth are in close proximity with, and may abut, the housing 112. A ratchet component 138 is contained in a lower, downhole, section of the tubing hanger plug 110. The ratchet component 138 comprises a plurality of grooves, which may be engaged with the teeth 124 of the valve sleeve 116.

As in the previous example, the tubing hanger 110 includes a barrier member in the form of a floating piston 128 located below the valve sleeve 116. The floating piston 128 is sealed with the housing 112 via O-ring seals 130, and includes a capped end 132, to provide isolation as in FIGS. 1 and 2. Spring 129 biases the floating piston in an upwards direction.

As shown in FIG. 3B, shear pins 142 hold the sleeve 116 in the configuration shown in FIG. 3A. The shear pins 142 are in engagement with a corresponding indent 144 in the surface of the sleeve 116.

As in FIGS. 1 and 2, the housing comprises lower ports 136, which function to expose the floating piston 128 to downhole pressure.

In use, the ball 122 will act on the seat 120 to move the valve sleeve 116. Once the ball 122 seats in the valve seat 120, fluid pressure will act on the upper surface of the ball 122, causing shear pins 142 to shear (alternatively/additionally, impact of the ball 122 on the seat may provide sufficient force to shear the pins 142) which, as shown in FIG. 4, will cause the sleeve 116 to shift axially and open the ports 114, thus providing pressure equalization across the tubing hanger plug 110. When the sleeve 116 is in the fully open position, the axes of the sleeve 116 and the fluid ports 114 are aligned, as shown in FIG. 4.

Axial shifting of the ball 122 and valve seat 120 causes the floating piston 128 to also move axially, permitting the trapped volume 134 to also move. Accordingly, the floating piston 128 may function to prevent hydraulic lock within the tubing hanger plug 110. The housing comprises a ridge 140 or axial shoulder which engages with a ridge 141 or shoulder on the floating piston to limit the movement of the floating piston 141, and therefore the sleeve 116, relative to the housing. The ridge 140 ensures that the spring 129 does not become fully compressed, and therefore may assist to preserve the longevity of the spring 129.

Upon axial shifting, the teeth 124 of the sleeve 116 move into engagement with the ratchet component 138. The ratchet component 138 may function to retain the sleeve 116 in the position as shown in FIG. 4, and may permit the sleeve 116 to maintain a degree of partial movement, which may be related to the proximity of the spacing of the grooves in the ratchet component 138.

In addition to retaining the apparatus in the fully open position as shown in FIG. 4, the ratchet component 138 may also permit the apparatus to be retained in a position where the fluid ports 114 and the bypass 123 are in partial alignment, i.e. where there is a degree of overlap between the fluid ports 114 and the bypass 123 and therefore a degree of fluid flow therethrough is possible, but the axes of the fluid ports 114 and bypass 123 are not aligned as shown in FIG. 4.

The fluid ports 114 may have a substantially oval shape in radial cross-section. Such a cross-sectional shape may enable the ports to provide a gradual increase in a rate of fluid flow therethrough, as the fluid ports 114 and the bypass 123 move from being misaligned (e.g. when the sleeve 116 is in the closed position of FIG. 3A) to being aligned (e.g. when the sleeve 116 is in the open position of FIG. 4).

Figure 5:
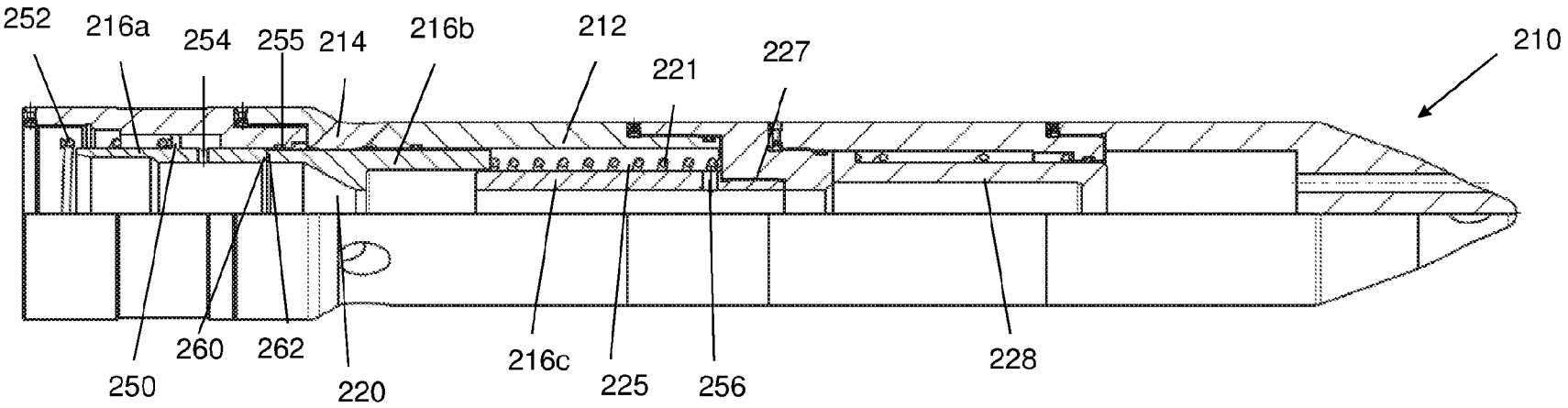
FIG. 5 is a cross-sectional view of a third example of a downhole apparatus.
Figure 6:
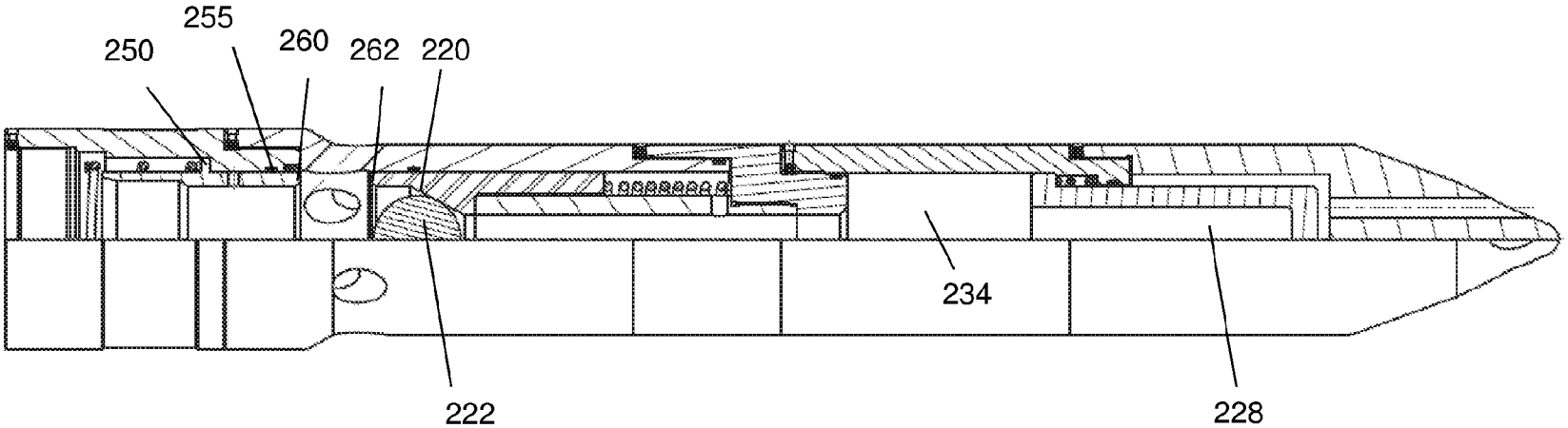
FIG. 6 is a cross-sectional view of a the downhole apparatus of FIG. 5 in a second configuration.

Reference is now made to FIGS. 5 and 6, which show a third example of a downhole apparatus in the form of tubing hanger plug 210. FIGS. 5 and 6 share similarities with FIGS. 1 and 2, and as such like reference numerals have been used for like components, augmented by 200.

In the example shown in FIGS. 5 and 6, the sleeve 216*a*, 216*b*, 216*c*, is separated into an upper sleeve 216*a*, an intermediate sleeve 216*b* and a lower sleeve 216*c*.

The upper sleeve 216*a* comprises a lip 250. The lip 250 is in contact with an upper spring 252 which functions to bias the upper sleeve 216*a* towards a downward position. Upper sleeve 216*a* is held in an upwards position as a lower end 260 of the upper sleeve 216*a* is in abutment with an upper end 262 of the intermediate sleeve 216*b*. Upper sleeve 216*a* also comprises an upper sleeve port 254 which functions to facilitate movement of the upper sleeve 216*a* relative to the housing 212 by allowing fluid to escape from between the upper sleeve 216*a* and the housing 212, upon movement of the upper sleeve 216*a* (i.e., prevents hydraulic locking of sleeve 216*a*).

The intermediate sleeve 216*b* comprises a seat 220, and is biased towards an upper position by spring 221, so as to close the fluid ports 214. Seal 255 prevents fluid flow between sleeve 216*a*, 216*b*, 216*c* and the housing 212 to the fluid ports 214. The inner surface of the intermediate sleeve 216*b* is in sliding engagement with the outer surface of the lower sleeve 216*c*. The spring 221 is held in an annulus 225 between the lower sleeve 216*c* and the housing 212. The lower sleeve 216*c* comprises a threaded portion 227 and is fixed relative to the housing 212 by threaded engagement. The lower sleeve 216*c* comprises a lower sleeve aperture 256 to allow fluid to enter and exit the annulus 225, preventing hydraulic locking.

In use, ball 222 (FIG. 6) acts on the seat 220, and therefore the intermediate valve sleeve 216*b* to cause the intermediate valve sleeve 216*b* to shift axially relative to the housing 212 and open ports 214, thus providing pressure equalizations across the tubing hanger 210, as also shown in the previous examples.

As the intermediate sleeve 216*b* shifts axially, upper spring 252 shifts the upper sleeve 216*a* downwardly until lip 250 of the upper sleeve 216*a* moves into abutment with the housing 212. As the intermediate sleeve 216*b* moves downwardly, the upper end 262 of the intermediate sleeve 216*b* moves past the seal 255. At the same time, the lower end 260 of the upper sleeve 216*a*, which is initially in abutment with the upper end 262 of the intermediate sleeve 216*b*, moves over the seal 255. As such, the upper sleeve 216*a* and intermediate sleeve 216*b* together ensure that the seal 255 is contained between the sleeve 216*a*, 216*b* and the housing 212, and thus protected from exposure to fluid flow/debris in the apparatus.

The range of axial shifting of the intermediate sleeve 216*b* is greater than that of the upper sleeve 216*a*, and upon engagement of the ball 222 with the sleeve 220, the intermediate sleeve 216*b* moves, from a closed position, out of abutment with the upper sleeve 216*a* and towards an open position to expose fluid ports 214. Downwards axial shifting of the intermediate sleeve 216*b* is limited by engagement of the intermediate sleeve 216*b* with the lower sleeve 216*c*, as shown in FIG. 6.

As in the previous examples, axial shifting of the sleeve 216*a*, 216*b* causes the floating piston 228 to move axially, permitting the trapped volume 234 to also move. Accordingly, the floating piston 228 may function to prevent hydraulic lock within the tubing hanger plug 210.

Figure 7:
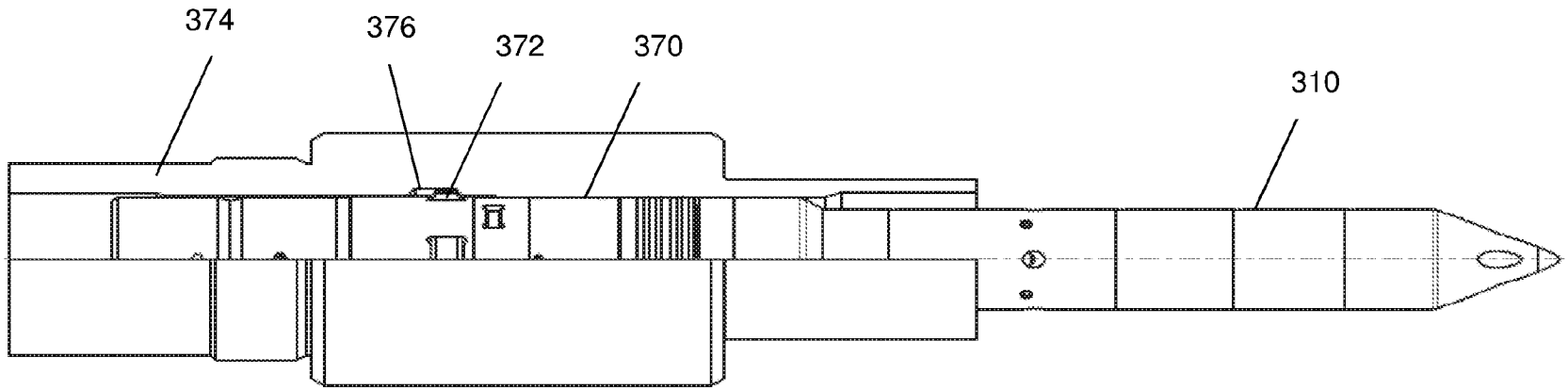
FIG. 7 is an illustration of an application of the downhole apparatus shown in FIGS. 3A, 3B and 4.

FIG. 7 shows an application of a tubing hanger plug 310, which tubing hanger plug 310 may be provided in accordance with any of the examples provided above. FIG. 7 shares similarities with FIGS. 1 and 2, and as such like reference numerals have been used for like components, augmented by 300.

As shown, the tubing hanger plug 310 is connected to a wellbore tool 370. The wellbore tool 370 comprises engagement members 372, which in this case are in the form of dogs. The tubing hanger plug 310 and wellbore tool 372 is positioned in, as shown in this example, a tubular component 374, which comprises an engagement profile 376. The tubular component 374 may form part of a completion, such as an upper completion, lower completion etc. In some examples the tubular component 374 may comprise a seal receptacle, such as a polished bore receptacle.

In this example, the apparatus is able to be actuated so as to engage the engagement members 372 with the engagement profile 376. Actuation may be, for example, by movement of the sleeve (shown in FIGS. 1-6) of the tubing hanger plug 310.

The invention claimed is:

1. A downhole apparatus, comprising:

a housing;

a seat mounted in the housing and configured to receive an object such that the object may engage and axially move the seat to operate the downhole apparatus; and a moveable barrier located on one axial side of the seat such that when the object is engaged with the seat a volume is defined between the object and the moveable barrier, wherein the moveable barrier permits said volume to be moved within the downhole apparatus to allow the object to axially move the seat;

the moveable barrier defining a sealed barrier so as to permit movement of the moveable barrier while preventing fluid flow through the housing, wherein the downhole apparatus is a tubing hanger plug.

2. The downhole apparatus according to claim 1, comprising a valve, wherein the valve is reconfigurable at least from a closed position to an open position upon axial movement of the seat.

3. The downhole apparatus according to claim 1, comprising a valve member, wherein movement of the seat causes corresponding movement of the valve member.

4. The downhole apparatus according to claim 3, wherein the valve member and the seat are integrally formed.

5. The downhole apparatus according to claim 3, wherein the valve member comprises a valve sleeve.

6. The downhole apparatus according to claim 3, wherein the valve member is comprised of multiple parts.

7. The downhole apparatus according to claim 3, wherein the housing defines at least one flow port in a wall thereof, wherein the valve member is configured to initially close said at least one flow port and be axially moved by the seat to cause said at least one flow port to open.

8. The downhole apparatus according to claim 7, wherein the at least one flow port is openable to provide pressure equalization across the downhole apparatus.

9. The downhole apparatus according to claim 1, wherein the seat comprises an object engaging surface.

10. The downhole apparatus according to claim 1, wherein the seat is moveable between a closed position, an open position and a plurality of intermediate positions between the closed and open positions.

11. The downhole apparatus according to claim 1, comprising a latching mechanism for latching the seat within the housing in at least one position.

12. The downhole apparatus according to claim 1, wherein the moveable barrier comprises a piston member axially moveable within the housing.

13. The downhole apparatus according to claim 1, wherein the moveable barrier is biased in one axial direction by a biasing mechanism, and movement of the moveable barrier in the other axial direction against the biasing member is limited by the structure of the housing.

* * * * *